United States Patent [19]

Syred et al.

[11] 4,112,977

[45] Sep. 12, 1978

[54] VORTEX DIODES

[76] Inventors: Nicholas Syred; John Grant; Baldip Singh Sidhu, all of United Kingdom Atomic Energy Authority II Charles II St., London, England, SW1

[21] Appl. No.: 805,917

[22] Filed: Jun. 13, 1977

[30] Foreign Application Priority Data

Jun. 22, 1976 [GB] United Kingdom ..... 25974/76

[51] Int. Cl.[2] ..... F15C 1/16

[52] U.S. Cl. ..... 137/812

[58] Field of Search ..... 137/808, 809, 810, 811, 137/812, 813

[56] References Cited

U.S. PATENT DOCUMENTS

| | | | |
|---|---|---|---|
| 3,198,214 | 8/1965 | Lorenz | 137/813 |
| 3,447,383 | 6/1969 | Camarata | 137/809 X |
| 3,563,260 | 2/1971 | Ellis | 137/812 |
| 3,849,086 | 11/1974 | Johnson | 137/812 X |
| 4,003,405 | 1/1977 | Hayes et al. | 137/811 X |

FOREIGN PATENT DOCUMENTS

| | | | |
|---|---|---|---|
| 470,664 | 5/1975 | U.S.S.R. | 137/812 |

*Primary Examiner*—William R. Cline

*Attorney, Agent, or Firm*—Larson, Taylor and Hinds

[57] ABSTRACT

A vortex diode having a thin cylindrical vortex chamber with an axial port and at least one tangential port. The chamber is provided with a peripheral channel and the diameter of each tangential port is substantially equal to the diameter of the peripheral channel.

6 Claims, 2 Drawing Figures

VORTEX DIODES

FIELD OF THE INVENTION

This invention concerns fluidic devices, in particular to devices in which fluid flow can be controlled by producing a vortex in the fluid so as to present a higher impedance to flow in one direction than in the other. Such devices are termed vortex diodes.

BACKGROUND OF THE INVENTION

A known form of vortex diode comprises a thin cylindrical chamber having a tangential port in the peripheral wall thereof and an axial port in an end wall thereof, the fluid flow entering and leaving the chamber by way of these ports. There are two modes of operation. Thus if flow enters through the axial port and exits through the tangential port no appreciable vortex is formed in the chamber and the resistance to flow is relatively small. On the other hand if flow enters through the tangential port and exits through the axial ports a vortex forms within the chamber and the resistance to flow is relatively high. For convenience, the two modes of operation can be termed low and high resistance respectively.

SUMMARY OF THE INVENTION

The present invention seeks to improve upon existing known vortex diodes by paying particular attention to geometrical parameters of the diode so as to give optimum results for both high and low resistance modes.

According to the present invention a vortex diode comprises a thin cylindrical vortex chamber having an axial port and at least one tangential port, the diameter of the or each tangential port at its junction with the chamber being substantially equal to the height of the chamber at its periphery.

Conveniently the chamber is formed with an enlarged peripheral channel having a diameter substantially equal to the diameter of the or each tangential port.

BRIEF DESCRIPTION OF THE DRAWINGS

The invention will be described further, by way of example, with reference to the accompanying drawings, in which.

DETAILED DISCRIPTION OF THE PREFERRED EMBODIMENTS

Figure 1:
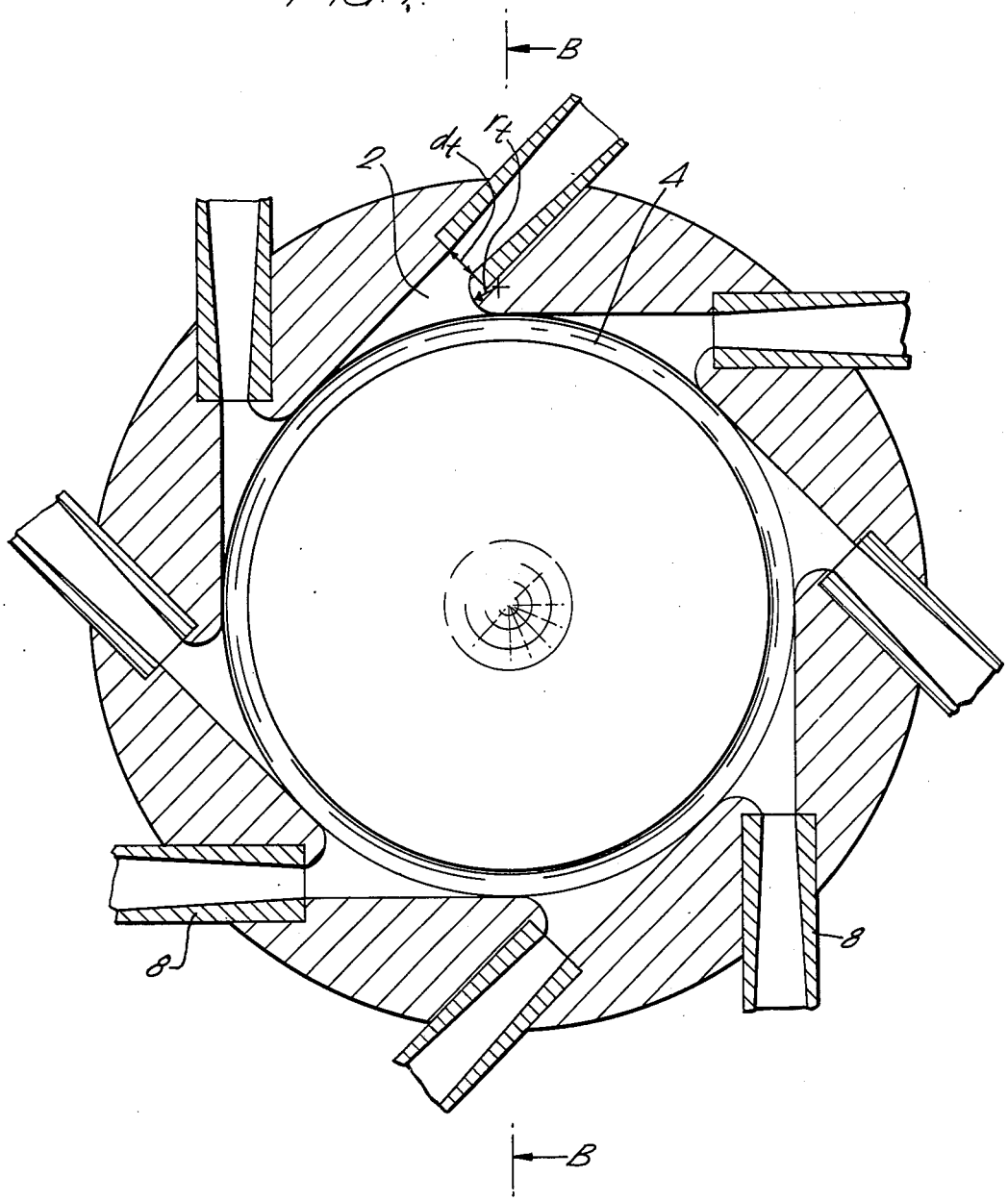
FIG. 1 is a section plan view of a vortex diode on the line A—A in FIG. 2.
Figure 2:
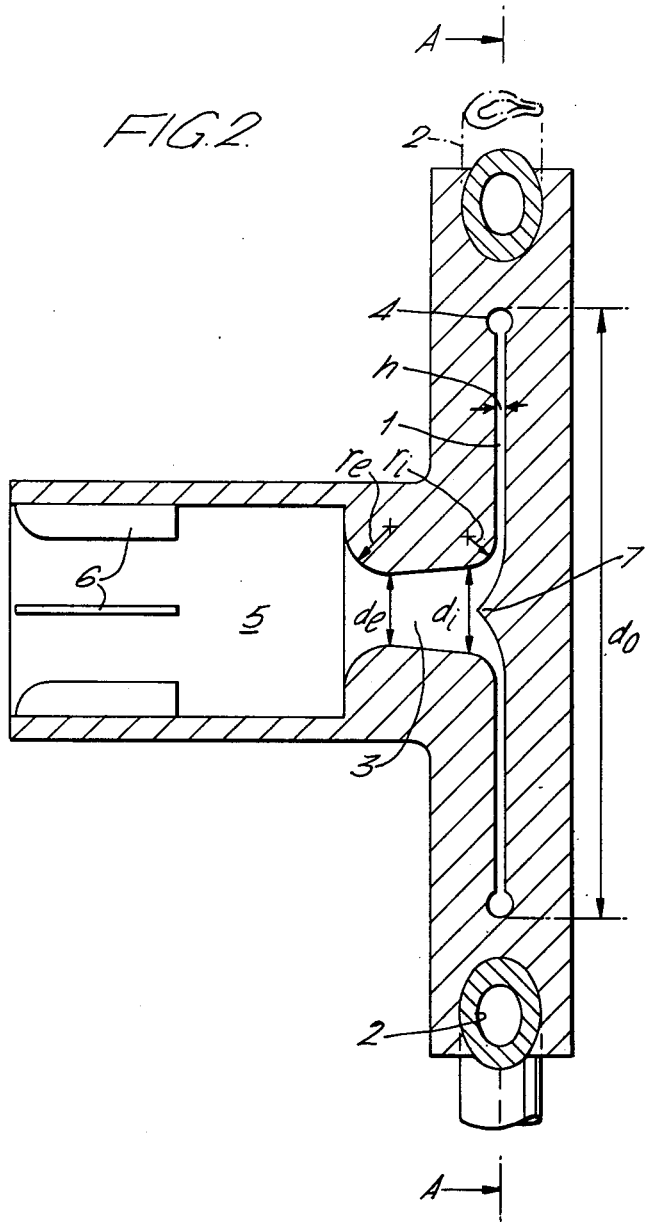
FIG. 2 is a section along the line B—B in FIG. 1.

FIGS. 1 and 2 show a vortex diode having a thin cylindrical vortex chamber 1 with a plurality of tangential ports 2 and an axial port 3. The illustrated embodiment has eight tangential ports 2 but this number is merely given as an example and the diode can have any desired number of tangential ports. The tangential ports 2 communicate with an enlarged channel 4 formed about the periphery of the vortex chamber.

The axial port 3 has a slight taper as seen from FIG. 2, the port having a maximum diameter at its junction with the vortex chamber 1 and a minimum diameter at its opposite end communicating with a flow channel 5. Flow straightener means or swirl vanes 6 can be provided in the flow channel. Such vanes 6 reduce cavitation in the flow through the diode and improve performance when functioning in the high resistance mode.

A projection 7 can be formed on the surface of the chamber directly opposite the axial port. The projection extends towards but stops short of junction of the axial port with the vortex chamber at the region of maximum diameter of the axial port. The axial port merges with the vortex chamber in a smooth continuous curved surface and the projection is formed with a complementary curved surface so as to reduce variation in cross-sectional area of the flow path at the junction of the axial port with the vortex chamber.

For optimum performance of the vortex diode in both the higher and low resistance modes of operation careful attention should be given to the geometry of the diode and the relationships of particular parameters. These parameters will be denoted by the following symbols which are shown in the drawings.

- $h$ - height of vortex chamber 1
- $d_o$ - overall diameter of the chamber 1
- $d_i$ - diameter of axial port 3 at its region of merger with the vortex chamber 1
- $r_i$ - radius of curvature at the junction between axial port 3 and the vortex chamber
- $d_e$ - diameter of axial port 3 at its end remote from the vortex chamber
- $r_e$ - radius of curvature at the junction of the axial port 3 with the flow passage communicating therewith
- $d_t$ - diameter of tangential port 2 at its region of merger with the vortex chamber
- $r_t$ - radius of curvature at the junction of the tangential port 2 with the vortex chamber.

When operating in its low resistance mode flow enters the chamber 1 through the axial port 3 and exhausts through the tangential ports 2. The axial port forms a short conical diffuser section from which the flow diffuses radially outwardly in the vortex chamber in a substantially uniform pattern. The flow enters the channel 4 about the periphery of the chamber and passes into the tangential ports which again form conical diffusers to recover the pressure energy. As shown, the tangential ports can be formed as inserts 8 having a push-fit in the main body of the diode. The inserts can be cemented or bonded in position and are connected to a flow manifold. Alternatively, the tangential ports can be formed as drillings in the body of the diode. The diameter of the channel 4 is substantially equal to $d_t$.

Pressure loss at the tangential ports is influenced by the relationship between $r_t$ and $d_t$. If the ratio $r_t/d_t$ is small then a considerable pressure loss can be experienced. Alternatively an increase in the ratio $r_t/d_t$ will reduce the pressure loss in the low resistance mode but adversely affects the performance in the high resistance mode of operation. Conveniently the ratio $r_t/d_t$ can be in the range 0.5 to 2 and preferably the ratio should approach 1. A ratio $r_t/d_t$ within the range 0.9 to 1.1 results in a favourable compromise between low resistance in the low resistance mode and a high resistance in the high resistance mode of operation. The diameter of the peripheral channel about the vortex chamber should preferably approach or equal the diameter $d_t$. The length of each tangential port is such that the diameter at the end thereof remote from the vortex chamber is at least 2 $d_t$.

To prevent flow separation at the junction of the axial port and the chamber it is desirable that $r_i$ should be greater than 0.3 $d_i$ and not greater than 3 $d_i$. Conveniently, $r_i$ can be 0.375 $d_i$ to prevent flow separation art the junction in the low resistance mode of operation.

Further $r_e$ should preferably lie within the range 0.3 $d_e$ to 4 $d_e$.

The cross-sectional area $A_e$ of the axial port ($\pi\ d_e^2/4$) and the total cross-sectional area $A_t$ of the tangential ports ($x\ \pi\ d_t^2/4$) where x is the number of tangential ports should be such that $A_t/A_e$ is within the range 0.5 to 2.0. Conveniently the ratio $A_t/A_e$ can be within the range 1.1 to 1.7.

The relationship between $h$ and $d_e$ is such that $h/d_e$ ranges from 0.1 to 0.5 and the ratio $d_o/d_e$ can range from 4:1 to 10:1. Preferably, $h/d_e$ is 0.2 and $d_o/d_e$ is about 7:1 to give maximum resistance in the high resistance mode of operation.

The chamber can merge smoothly into the outer peripheral channel by gradually increasing the height of the chamber in a radially outward direction so that at the extremity of the chamber the height is equal to the diameter of the channel and hence the diameter of the or each tangential port.

For optimum results the area of the conical diffuser section formed by the axial port 3 at its junction with the vortex chamber is equal to or approaches the peripheral area of the chamber at the junction.

Thus, preferably, $$\frac{\pi}{4}\ d_i^2 \simeq \pi(d_i + 2r_i \cos\theta)\ h$$

where $\theta$ is half the angle of the diffuser section. That is $\theta$ is the angle of inclination of the wall of the diffuser section to the longitudinal axis of the axial port. The angle of the diffuser section can be about 7° and hence $\theta$ can be 3½° . As a first approximation the course of such a small angle can be considered equal to 1 and consequently $$\frac{\pi}{4}\ d_i^2 \simeq \pi(d_i + 2_{r_i})\ h\ .$$

As mentioned above the preferred relationship between $r_i$ and $d_i$ is such that $$r_i = 0.375\ d_i$$

Hence, substituting the value of $r_i$ in the previous equation gives $$\frac{\pi}{4}\ d_i^2 \simeq \pi \cdot 1.75 d_i \cdot h$$

from which $$h \simeq d_i/7$$

The above relationships apply to both the low and high resistance modes. Whilst not restricted to any particular number of tangential ports, generally, it is recommended to have as many tangential ports as possible. This will improve flow symmetry and reduce pressure losses.

We claim:

1. A vortex diode comprising a thin cylindrical vortex chamber, a peripheral channel about the chamber, an axial port and at least one tangential port in communication with the chamber, characterized by the following geometric parameters:

(a) the diameter $d_t$ of at least one tangential port at the region of merger thereof with the channel is substantially equal to the diameter of the channel;

(b) the ratio $r_t/d_t$, where $r_t$ and $d_t$ are, respectively, the radius of curvature at the junction of a tangential port with the vortex chamber and the diameter of the tangential port at its region of merger with the chamber, lies in the range 0.5 to 2;

(c) the ratio $r_i/d_i$, where $r_i$ and $d_i$ are, respectively, the radius of curvature at the junction between the axial port and the vortex chamber and the diameter of the axial port at its region of merger with the vortex chamber, lies in the range 0.3 to 3;

(d) the ratio $r_e/d_e$, where $r_e$ and $d_e$ are, respectively, the radius of curvature at the junction between the axial port with a flow passage at the end of the axial port remote from the chamber and the diameter of the axial port at its end remote from the chamber, lies in the range 0.3 to 4;

(e) the ratio $A_t/A_e$, where $A_t$ and $A_e$ are, respectively, the cross-sectional areas of the axial and tangential ports at the regions of merger with the chamber, lies in the range 0.5 to 2;

(f) the ratio $h/d_e$, where $h$ is the internal height of the chamber, ranges from 0.1 to 0.5; and (g) the ratio $d_o/d_e$, where $d_o$ is the overall diameter of the chamber, ranges from 4 to 10.

2. A vortex diode according to claim 1 in which the ratio rt/dt is substantially 1.

3. A vortex diode according to claim 1 in which $r_i$ is equal to 0/375 $d_i$.

4. A vortex diode according to claim 1 in which the diameter of the axial port increases progressively from $d_e$ to $d_i$.

5. A vortex diode according to claim 1 in which At/Ae is in the range 1.1 to 1.7.

6. A vortex diode according to claim 1 in which the height of the chamber increases progressively between the axial port and the tangential ports such that at its outer extremity the height of the chamber is equal to the diameter of the peripheral channel about the vortex chamber.

* * * * *